US008253002B2

(12) United States Patent
Christmas

(10) Patent No.: US 8,253,002 B2
(45) Date of Patent: Aug. 28, 2012

(54) DRUM TUNING DEVICE

(76) Inventor: Peter Christmas, Brough (GB)

( * ) Notice: Subject to any disclaimer, the term of this patent is extended or adjusted under 35 U.S.C. 154(b) by 118 days.

(21) Appl. No.: 12/671,695

(22) PCT Filed: Jul. 30, 2008

(86) PCT No.: PCT/GB2008/002590

§ 371 (c)(1),
(2), (4) Date: Feb. 1, 2010

(87) PCT Pub. No.: WO2009/016365

PCT Pub. Date: Feb. 5, 2009

(65) Prior Publication Data

US 2011/0154973 A1 Jun. 30, 2011

(30) Foreign Application Priority Data

Aug. 2, 2007 (GB) ..... 0714950.3

(51) Int. Cl.
*G10D 13/02* (2006.01)

(52) U.S. Cl. ..... 84/421; 84/413

(58) Field of Classification Search ..... 84/413, 84/421, 411 R, 312 R
See application file for complete search history.

(56) References Cited

U.S. PATENT DOCUMENTS

| | | | | |
|---|---|---|---|---|
| 4,314,498 | A | 2/1982 | Hofstad | |
| 4,791,849 | A | 12/1988 | Kelley | |
| 4,889,029 | A * | 12/1989 | St. Denis | 84/454 |
| 5,157,212 | A * | 10/1992 | Fleming | 84/413 |
| 2002/0092408 | A1 | 7/2002 | Milano | |
| 2006/0272478 | A1 | 12/2006 | Steinhour et al. | |
| 2007/0084328 | A1 * | 4/2007 | Kashioka | 84/413 |

FOREIGN PATENT DOCUMENTS

| | | |
|---|---|---|
| DE | 3405283 | 9/1985 |
| DE | 19647813 | 6/1998 |
| GB | 2202075 | 9/1998 |
| WO | 95/10829 | 4/1995 |

OTHER PUBLICATIONS

Evans drumheads, "Drill bit Drum Key".
United Kingdom Search Report of GB0714950.3.
International Search Report of PCT/GB2008/002590.

* cited by examiner

*Primary Examiner* — Kimberly Lockett

(57) ABSTRACT

A drum tuning device (10) comprises a drive head (14) adapted to engage a head of a drum skin tension control device, a motor (24, see FIG. 6) for rotating the drive head and control means for controlling rotation of the drive head. The control means includes three push buttons (16,18,20), which each control rotation of the drive head (14) to different pre-selectable angles of rotation.

20 Claims, 7 Drawing Sheets

DRUM TUNING DEVICE

The present invention relates to a drum tuning device.

A conventional drum typically includes a cylindrical drum body, two drum skins which are also known as heads, each covering an end of the drum body and two annular drum hoops for holding the respective drum skins onto the body. The tension in each drum skin determines its tuning. A set of mechanical tension control devices are spaced around the periphery of each drum hoop and retain the drum hoop on the drum body. The tension control devices can be tightened or slackened to increase or decrease the tension of a skin retained by a respective drum hoop.

Each tension control device comprises a male threaded part, usually a bolt, and a corresponding female threaded part. The female threaded part is fixed to the drum body and the bolt passes through an aperture in the drum hoop and is engaged in the female threaded part. For tuning, tightening of the bolt into the female threaded part draws the drum hoop towards the centre of the drum and tightens the drum skin. Conversely, slackening of the bolt loosens the drum skin. Ideally, a set of bolts holding a particular drum hoop are tightened to the same tension, in order to provide an even tension and tuning across the respective drum skin. The bolts are usually rotated using a hand held key.

A typical key has a socket portion for engaging each bolt head and an integral fixed winged portion, enabling rotation of the key by hand. Another typical key includes a socket portion connected to a transverse bar and handle portion. This gives a mechanical advantage for tightening, but can be more awkward to use. Other keys include ratchet devices to allow slipping of the ratchet in one direction, but it is difficult to gauge the amount of rotation applied to each bolt using keys including ratchet devices. This makes it more difficult to achieve even tuning across a drum skin.

There are usually at least six bolts provided around the periphery of each drum hoop, but there may be many more if the drum is large. This being the case, there are at least twelve bolts on each drum and sixty bolts in a standard 5 piece drum kit. Hence the tuning process can be time consuming.

If a drum skin is worn or damaged, then it may have to be replaced. This requires removal of the respective drum hoop, by removal of all of the bolts which retain the drum hoop to the drum body to allow removal of the drum skin. When the drum skin is replaced, the bolts have to be re-inserted and tightened to the desired tuning tension. Again, this is a time consuming task.

During tuning, a minimum tension is usually applied to each bolt, and then the bolts are each turned through the same predetermined angle of rotation. This ensures that the skin is tensioned evenly to the desired tension. However, it is not easy to turn the bolts through the same angle, because this has to be gauged by eye.

According to the present invention there is provided a drum tuning device comprising a drive head adapted to engage a head of a drum skin tension control device, a motor for rotating the drive head and control means for controlling rotation of the drive head, the control means controlling rotation of the drive head to a specific pre-settable predetermined angle.

It is an advantage of the invention that a drum skin can be evenly tensioned from a minimal tension, by rotation of the bolts retaining the drum hoop through a predetermined angle. This avoids human error, enables accurate tuning and speedier tuning, and relieves pressure on the wrist and fingers of the person tuning, who would until now, have tuned using a manual key as previously described.

Preferably, the control means includes a switch means for actuating rotation of the drive head to the said predetermined angle.

Furthermore, the control means preferably includes a plurality of switch means, each for actuating rotation of the drive head to a different specific pre-settable predetermined angle.

The control means may also include three switch means for actuating rotation of the drive head to respective angles of 90°, 180° and 360°.

Each switch means may be a push button, or other suitable switch.

Preferably the control means includes a trigger for actuating rotation of the drive head, when the trigger is depressed.

Preferably the drive head can be driven in either direction.

Preferably the motor is a stepper motor.

Preferably the motor drives though a gearbox.

Preferably the motor drives though a torque clutch, which prevents driving of the drive head above a pre-determined torque setting.

Preferably adjustment means is provided for adjusting the torque setting of the torque clutch.

Preferably the device is battery powered.

Preferably the device is powered by a rechargeable battery.

For a better understanding of the present invention, and to show more clearly how it may be carried into effect, reference will now be made, by way of example, to the accompanying drawings, in which.

Figure 1:
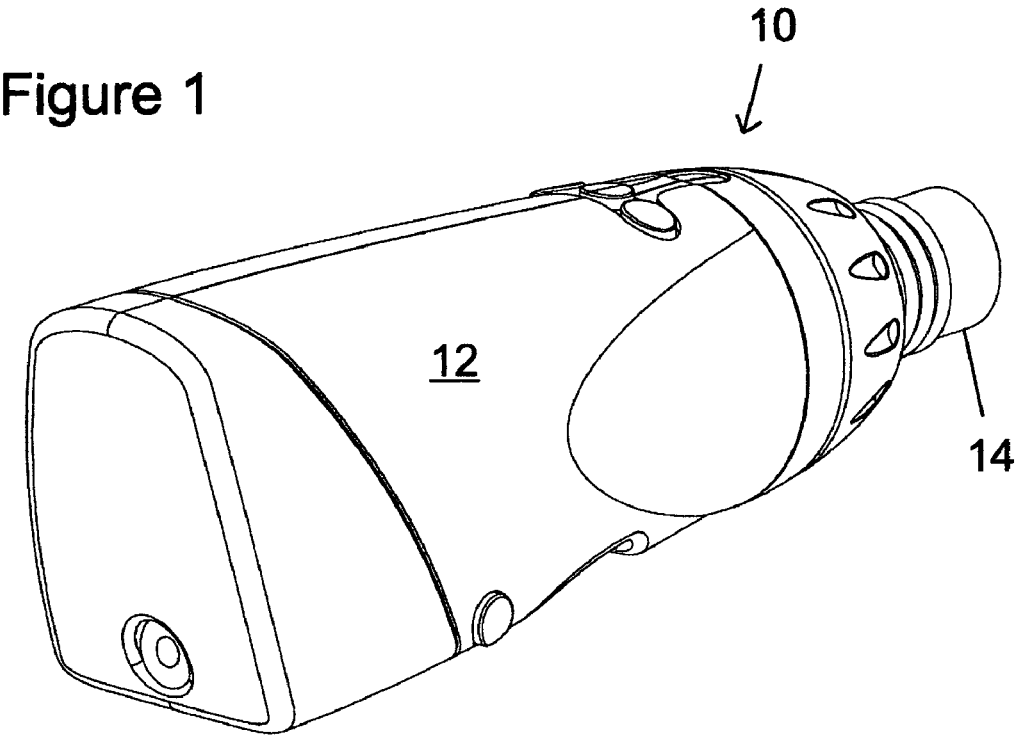
FIG. 1 shows a schematic perspective view from one side of a drum tuning device of the invention.
Figure 2:
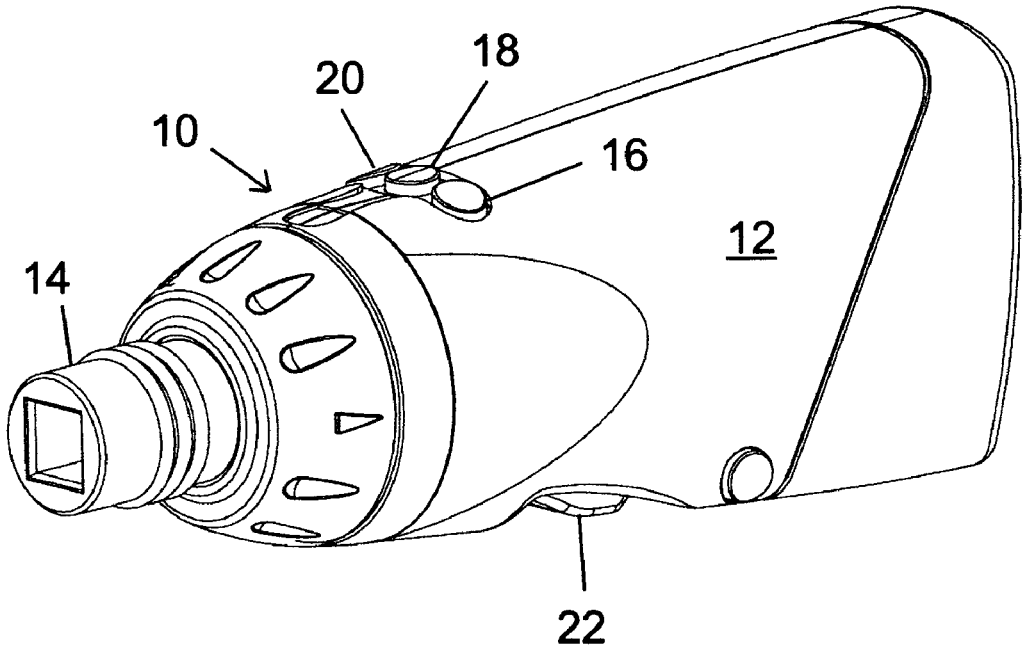
FIG. 2 shows a schematic perspective view of the drum tuning device of FIG. 1 from the other side.
Figure 3:
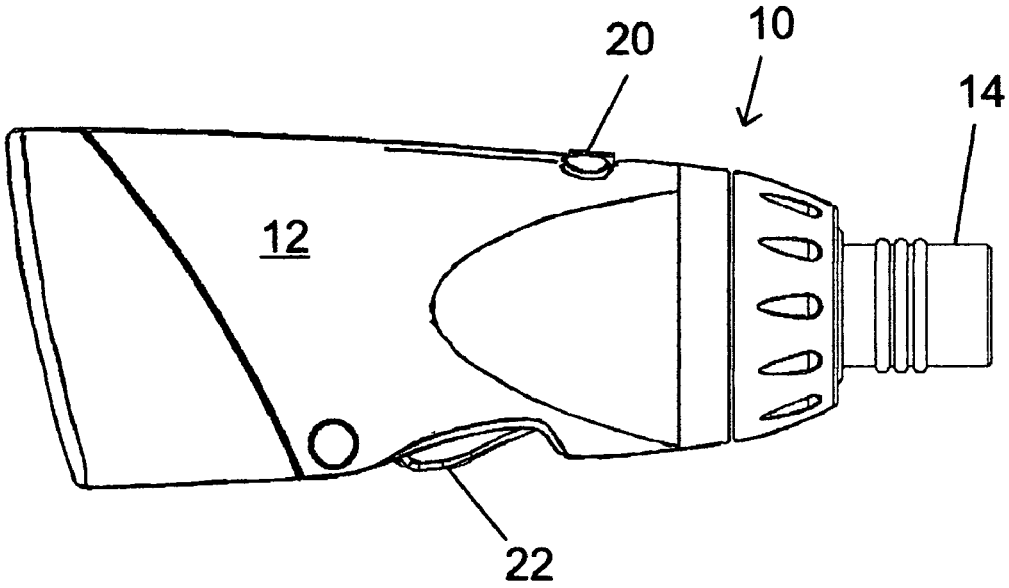
FIG. 3 shows a schematic side view of the drum tuning device of FIG. 1.
Figure 4:
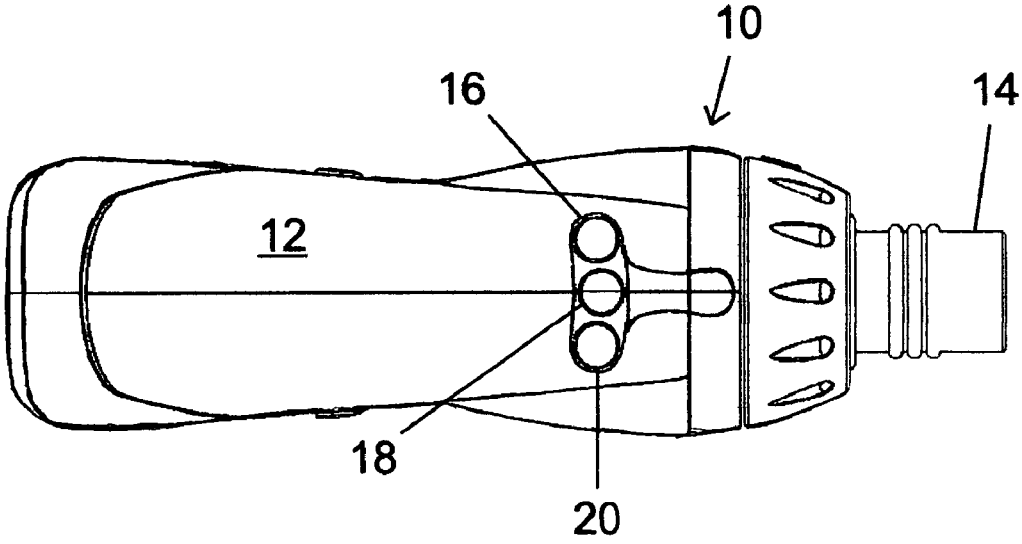
FIG. 4 shows a schematic plan view from above of the drum tuning device of FIG. 1.

Referring firstly to FIGS. 1 to 4, a drum tuning device is indicated generally at 10. The device 10 comprises an outer casing 12, moulded from plastics, and a drive head 14. Control means for controlling rotation of the drive head includes a plurality of push buttons 16,18,20, each for controlling rotation of the drive head to respective specific predetermined angles of rotation and a trigger 22 for continuous rotation of the drive head 14. As shown by the shaded emblems on the buttons in FIG. 5, the push button 16 controls actuation of the drive head to an angle of 90°, the push button 18 controls actuation of the drive head to an angle of 180° and the push button 20 controls actuation of the drive head to an angle of 360°.

Figure 5:
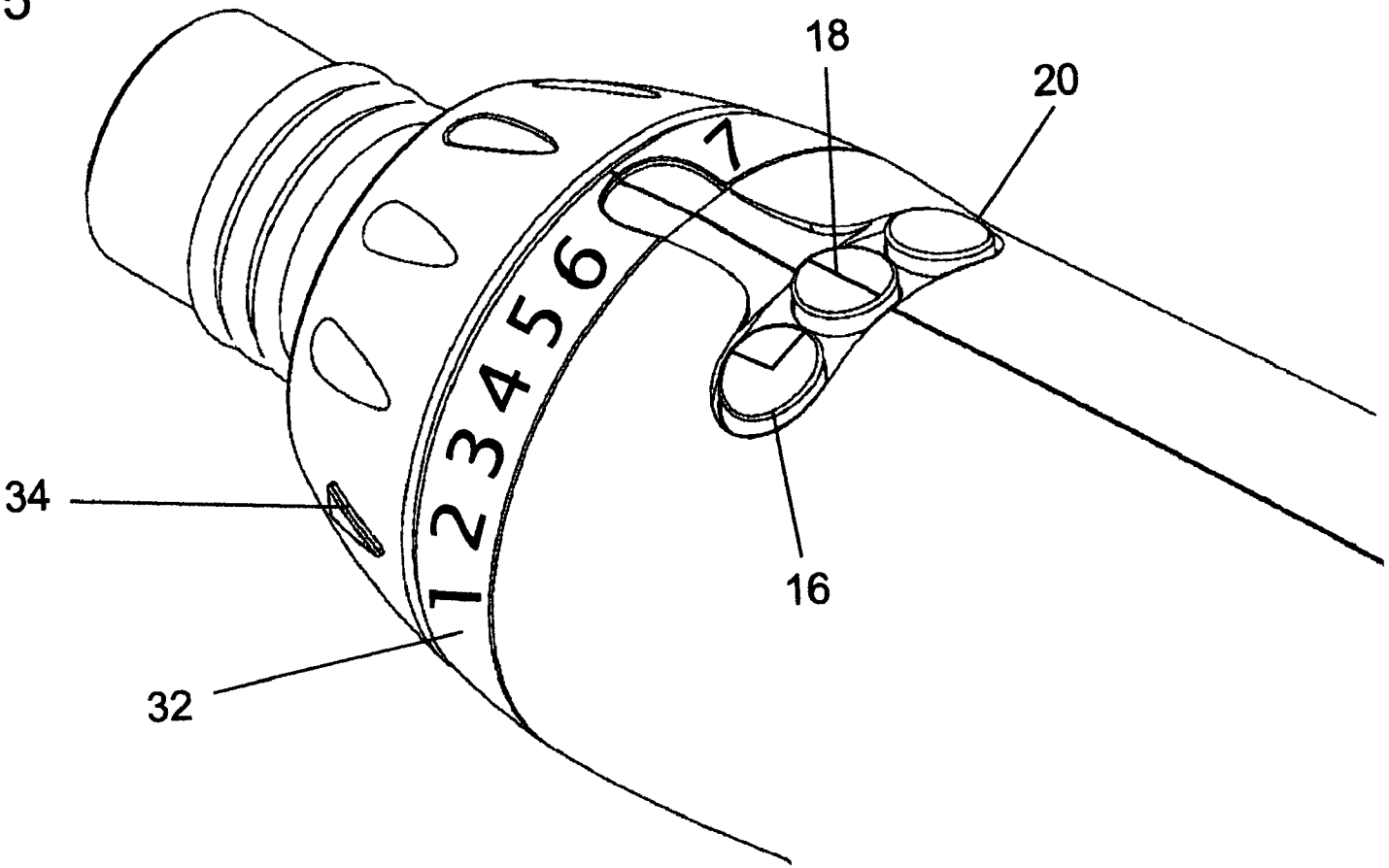
FIG. 5 shows a partial end view of the drum tuning device of FIG. 1.
Figure 6:
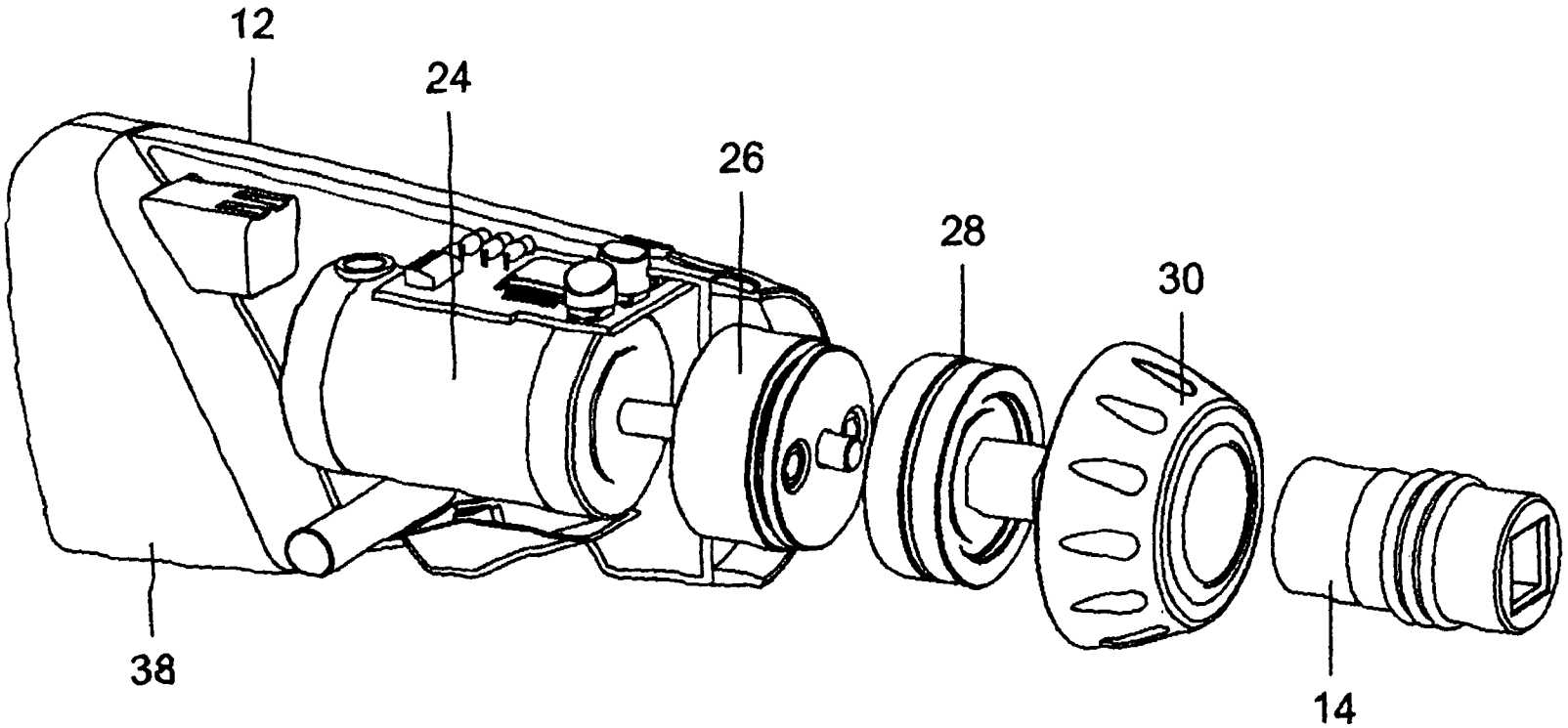
FIG. 6 shows an exploded part cut-away view of the drum tuning device of FIG. 1 from one side.
Figure 7:
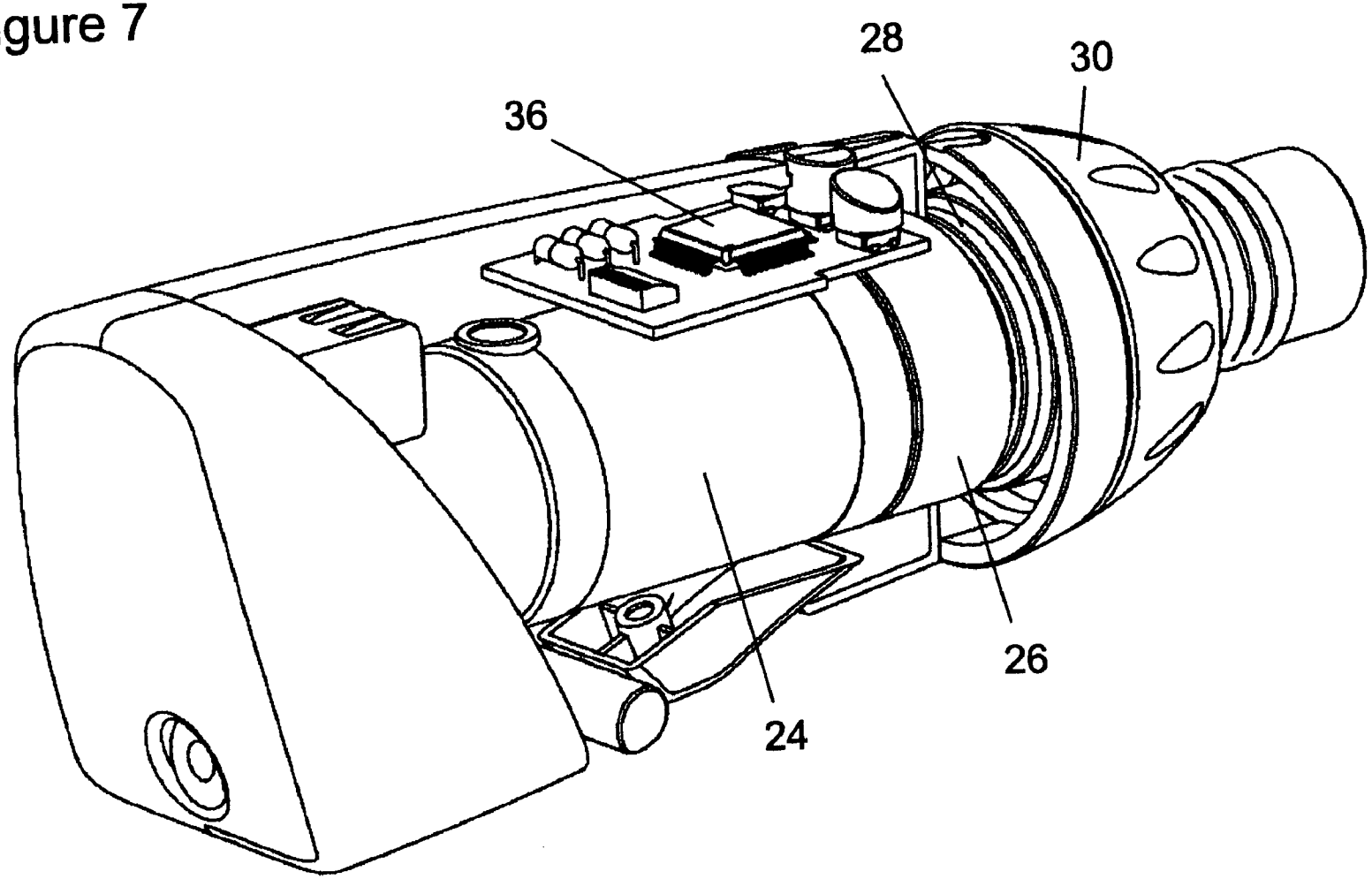
FIG. 7 shows a part cut-away view of the drum tuning device of FIG. 1 from one side.

Referring also to FIGS. 6 and 7, a stepper motor 24, a gearbox 26 and a torque clutch 28 are mounted inside the casing and drive the drive head 14. The stepper motor 24 passes drive to the gearbox 26, the gearbox 26 to the torque clutch 28 and the torque clutch to the drive head 14. An annular ring or bezel 30 is mounted around the torque clutch at the end of the casing 12 and can be used to set the torque at which the torque clutch slips. A graduated scale 32 is provided on the casing 12 of the device 10, as shown in FIG. 5, and an indicator arrow 34 on the ring 30 can be aligned with the desired torque setting as the ring is rotated relative to the casing.

Figure 9:
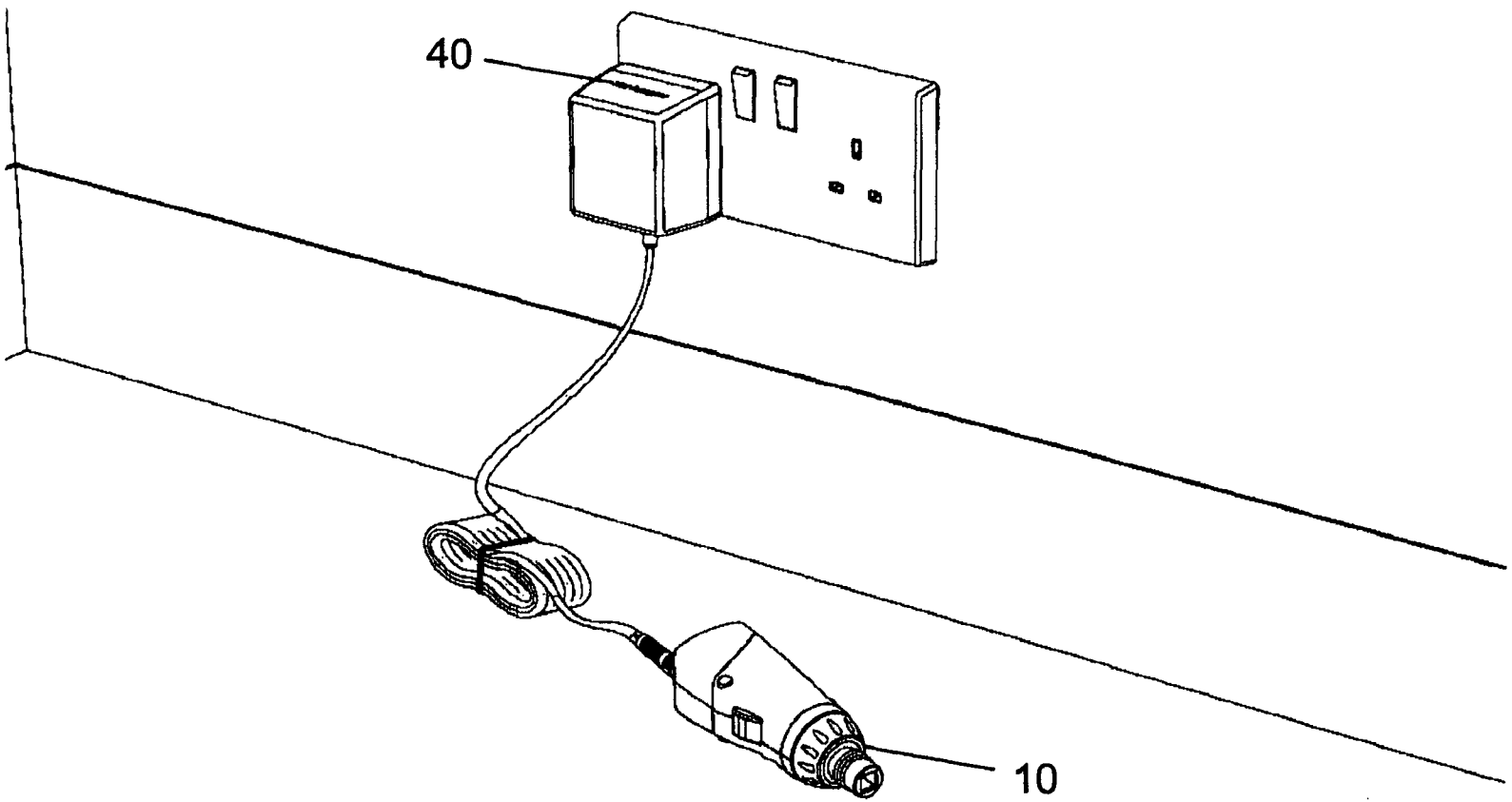
FIG. 9 shows the drum tuning device of FIG. 1 being charged from a mains power supply.

The push buttons 16,18,20 and other electronic control circuitry, including a micro-processor, are provided on a printed circuit board (PCB) 36, also disposed within the casing 12. A rechargeable battery 38 for powering the device is disposed in the rear of the casing 12, behind the stepper motor 24. A socket 38 for receiving a charging plug for recharging the rechargeable battery 38 is set in the rear of the casing. The rechargeable battery device is shown on charge in FIG. 9, connected to a mains power supply socket through a transformer 40. Optionally the rechargeable battery can be removed and replaced, and in another optional arrangement, the device can be powered by replaceable non-rechargeable batteries, for example, several AA batteries. The drive head 14 is provided with a square socket drive recess, which is suitable for driving the bolts of typical drum skin tension control means. However, this can be changed for any other drive means, suitable for tightening and slackening drum skins.

Figure 8:
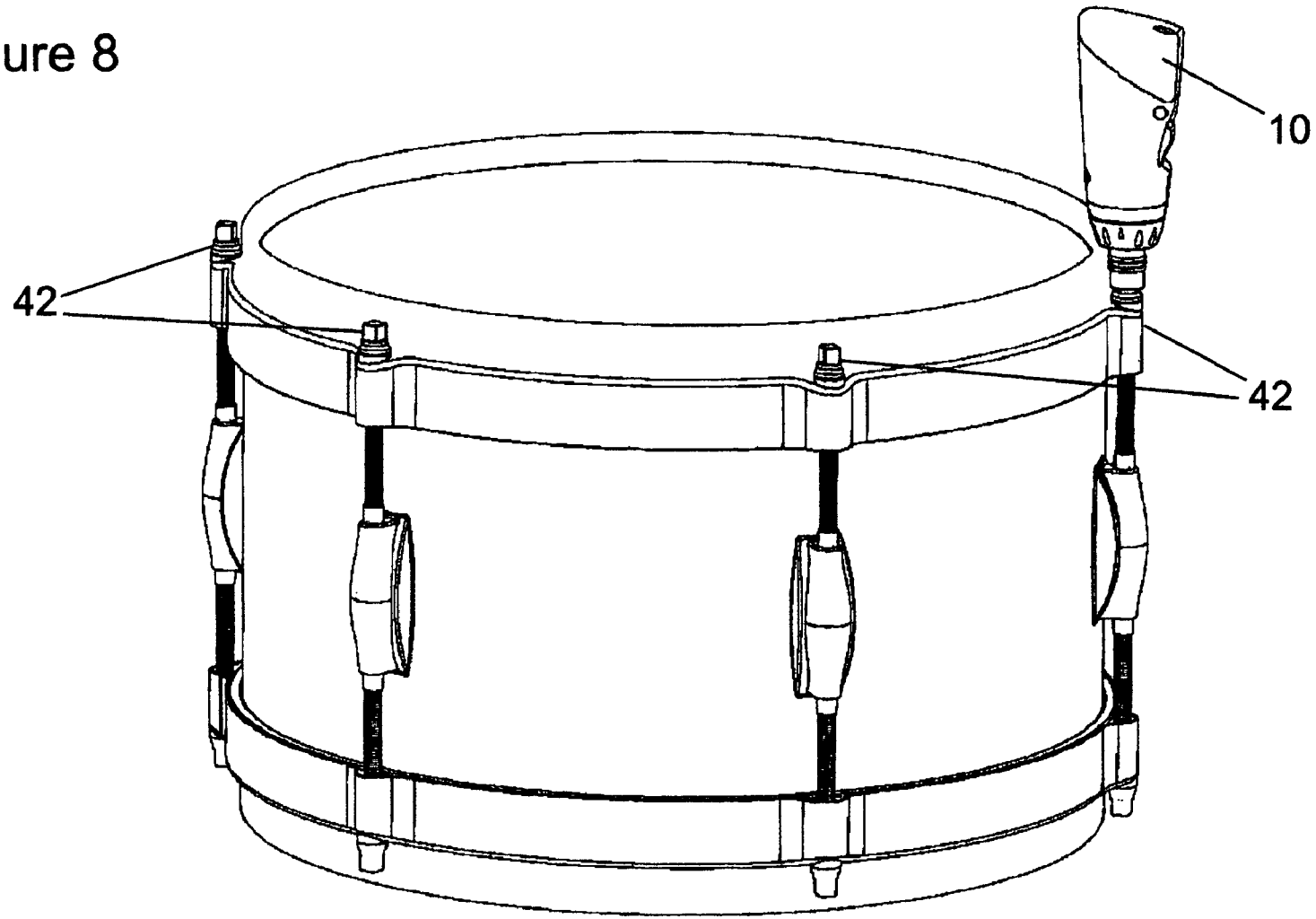
FIG. 8 shows the drum tuning device of FIG. 1 in use.

The operation of the device 10 is now described with reference to FIG. 8. The device 10 is shown with the drive head 14 engaged with one of a number of bolts 42 of a drum. The device 10 is hand held and the trigger 22 is used to rotate each of the bolts 42 to a minimal tension. The torque can be set using the annular ring 30 and graduated scale 32 prior to tightening. The torque setting can then be set to maximum, and a required rotation for tuning selected. For example, it may be desirable to rotate each of the bolts 42 by exactly 180°, in which case the device 10 is engaged with each bolt 42 in turn and the device actuated using the push button 18.

If rotation of the bolts 42 by exactly 90° is required, then push button 16 is selected and the control means controls the angular displacement of the drive head 14 so that it moves in a tightening direction to exactly 90° from its starting point.

Similarly, if rotation of the bolts 42 by exactly 360° is required, then push button 20 is selected and the control means controls the angular displacement of the drive head 14 so that it moves in a tightening direction to exactly 360° from its starting point.

As a consequence, the angular movement of the drive head to a specific and exact angle from its starting point is controlled by the device, allowing precise tightening of each bolt.

A means (not shown) is provided for changing the direction of drive of the device 10, which can also be used for slackening the bolts of the drum after use. This means may be uncontrolled, thereby allowing indiscriminate or unregulated loosening, and/or may include selection means for loosening the bolts by exact angular amounts, such as to 90°, 180° and 360°.

Although the control means is suggested as including a plurality of push buttons for switching between specific angular amounts of rotation, other selection means may be utilised, such as a single button, a dial or a lever which scrolls through or enables selection of various exact angles of rotation to which the drive head can be driven.

The device provides an effective way of tuning a drum skin with an even tension. The tuning process is easier than by hand, does not require such dexterity in the hand and is much quicker than with a manual key.

Although the control means controls the drive head to be rotated to one of a plurality of pre-settable or exact angles, the control means may have only one pre-set or specific angle to which the drive head can be rotated to, for example being 90°. In this case, the device is simply consecutively operated such that the drive head is rotated to consecutive specific angles. For example, if 180° was required, then the device is operated twice so that the drive head is moved firstly to 90° from its starting point, and then again so that the drive head is moved again by another 90°.

The embodiments described above are provided by way of examples only, and various other modifications will be apparent to persons skilled in the art without departing from the scope of the appended claims.

The invention claimed is:

1. A drum tuning device comprising a drive head adapted to engage a head of a drum skin tension control device, a motor for rotating the drive head and control means for controlling rotation of the drive head independently of drum skin tension, the control means controlling rotation of the drive head to a specific pre-settable predetermined angle.

2. A drum tuning device as claimed in claim 1, in which the control means includes a switch means for actuating rotation of the drive head to the said predetermined angle.

3. A drum tuning device as claimed in claim 1, in which the control means includes a plurality of switch means, each for actuating rotation of the drive head to a different specific pre-settable predetermined angle.

4. A drum tuning device as claimed in claim 1, in which the control means includes a trigger for actuating rotation of the drive head, when the trigger is depressed.

5. A drum tuning device as claimed in claim 1, in which the drive head can be driven in either direction.

6. A drum tuning device as claimed in claim 1, in which the motor is a stepper motor.

7. A drum tuning device as claimed in claim 1, in which the motor drives though a gearbox.

8. A drum tuning device as claimed in claim 1, in which the motor drives though a torque clutch, which prevents driving of the drive head above a pre-determined torque setting.

9. A drum tuning device as claimed in claim 8, in which adjustment means is provided for adjusting the torque setting of the torque clutch.

10. A drum tuning device as claimed in claim 1, in which the device is battery powered.

11. A drum tuning device as claimed in claim 1, in which the device is powered by a rechargeable battery.

12. A drum tuning device comprising a drive head adapted to engage a head of a drum skin tension control device, a motor for rotating the drive head and control means for controlling rotation of the drive head independently of drum skin tension, the control means controlling rotation of the drive head to a specific pre-settable predetermined angle; wherein the control means includes three switch means for actuating rotation of the drive head to respective angles of 90°, 180° and 360°.

13. A drum tuning device as claimed in claim 12, wherein the control means includes a trigger for actuating rotation of the drive head, when the trigger is depressed.

14. A drum tuning device as claimed in claim 12, wherein the drive head can be driven in either direction.

15. A drum tuning device as claimed in claim 12, wherein the motor is a stepper motor.

16. A drum tuning device as claimed in claim 12, wherein the motor drives though a gearbox.

17. A drum tuning device as claimed in claim 12, wherein the motor drives though a torque clutch, which prevents driving of the drive head above a pre-determined torque setting.

18. A drum tuning device as claimed in claim 16, wherein adjustment means is provided for adjusting the torque setting of the torque clutch.

19. A drum tuning device as claimed in claim 12, wherein the device is battery powered.

20. A drum tuning device as claimed in claim 12, wherein the device is powered by a rechargeable battery.

* * * * *